United States Patent [19]

Ho

[11] Patent Number: 4,771,897

[45] Date of Patent: Sep. 20, 1988

[54] KEY HANGING DEVICE

[76] Inventor: Jackson Ho, 1st Fl., 17, Lane 10, Chungshan Road, Sec. 2, Taipei, Taiwan

[21] Appl. No.: 103,741

[22] Filed: Oct. 2, 1987

[51] Int. Cl.[4] ..... A47F 7/00

[52] U.S. Cl. ..... 211/13; 211/94

[58] Field of Search ..... 211/13, 94, 10, 59.1, 211/94.5, 162, 123

[56] References Cited

U.S. PATENT DOCUMENTS

| | | | |
|---|---|---|---|
| 3,717,258 | 2/1973 | McKinnon | 211/94 X |
| 4,094,415 | 6/1978 | Larson | 211/94 X |
| 4,658,967 | 4/1987 | Wang | 211/94 |

FOREIGN PATENT DOCUMENTS

| | | | |
|---|---|---|---|
| 924232 | 2/1955 | Netherlands | 211/94 |

*Primary Examiner*—Reinaldo P. Machado

*Assistant Examiner*—Sarah A. Lechok Eley

*Attorney, Agent, or Firm*—Lowe, Price, LeBlanc, Becker & Shur

[57] ABSTRACT

A key hanging device for organizing and displaying keys is described. The device includes a frame having upper and lower C-shaped slots. The upper slot receives individual identification tablets for each respective key and the lower slot mounts a slidable hook member. One hook member is provided for each key and each hook member is aligned with its respective identification tablet. Each key also has an identification board which mounts identification indicia in a window and provides an aperture for hanging the key from the respective hook member. A mounting bracket is also provided which is slidably received within depending hook members on the back of the device, and the device is assembled using end cap members which engage the depending hooks.

4 Claims, 2 Drawing Sheets

KEY HANGING DEVICE

BACKGROUND OF THE INVENTION

This invention relates to a device for displaying and organizing a plurality of keys.

In a household normally there are a number of keys to doors, cabinets, cars and the like which are used on a random basis by various family members. Such keys are often scattered at random, on the tables, in drawers, handbags and pockets of various family members. When a key is needed then it is both inconvenient and frustrating to locate the specific key needed.

The device of this invention however is a simple and efficient means for both organizing and displaying a plurality of keys, and for identifying each of said keys.

SUMMARY OF THE INVENTION

The key hanging device of this invention consists of a basic frame member with individual identifiction tablets, one for each key which are slidably received in the frame member. Each tablet may have identifying information such as the lock the key is used for, or a serial number related to replacement of the key if lost. A transparent window is also slidably received within the frame member covering the individual identification tablets. The lower portion of the frame member mounts a track. Individual hook members are slidably received in the track with a hook member disposed immediately below and aligned with each table member. End pieces are provided which are slidably received within the frame member so that the identification tablets, window, and slidable hook members are all retained within the frame. a mounting bracket is also provided on the back of the frame for mounting on a wall. Each key to be displayed on the device then has a key identification board with an aperture therein. The key identification board could be color coded or numbered to correspond to the identification tablet and each board has an aperture for engaging the hook member.

Accordingly, it is an object of this invention to provide a key display rack so that keys may be both identified and displayed. It is another object of this invention to provide a key display rack which can display one, two or several keys and also provide identification as to which lock the individual key is for.

It is yet another object of this invention to provide a key display rack which is easily assembled or disassembled wherein individual keys are suspended from a hook member aligned with and disposed below an identification tablet wherein identifying information is displayed along with an identifying either number, color or the like. These and other objects will become readily apparent with reference to the drawings and following description wherein:

DETAILED DESCRIPTION OF THE PREFERRED EMBODIMENT

Figure 1:
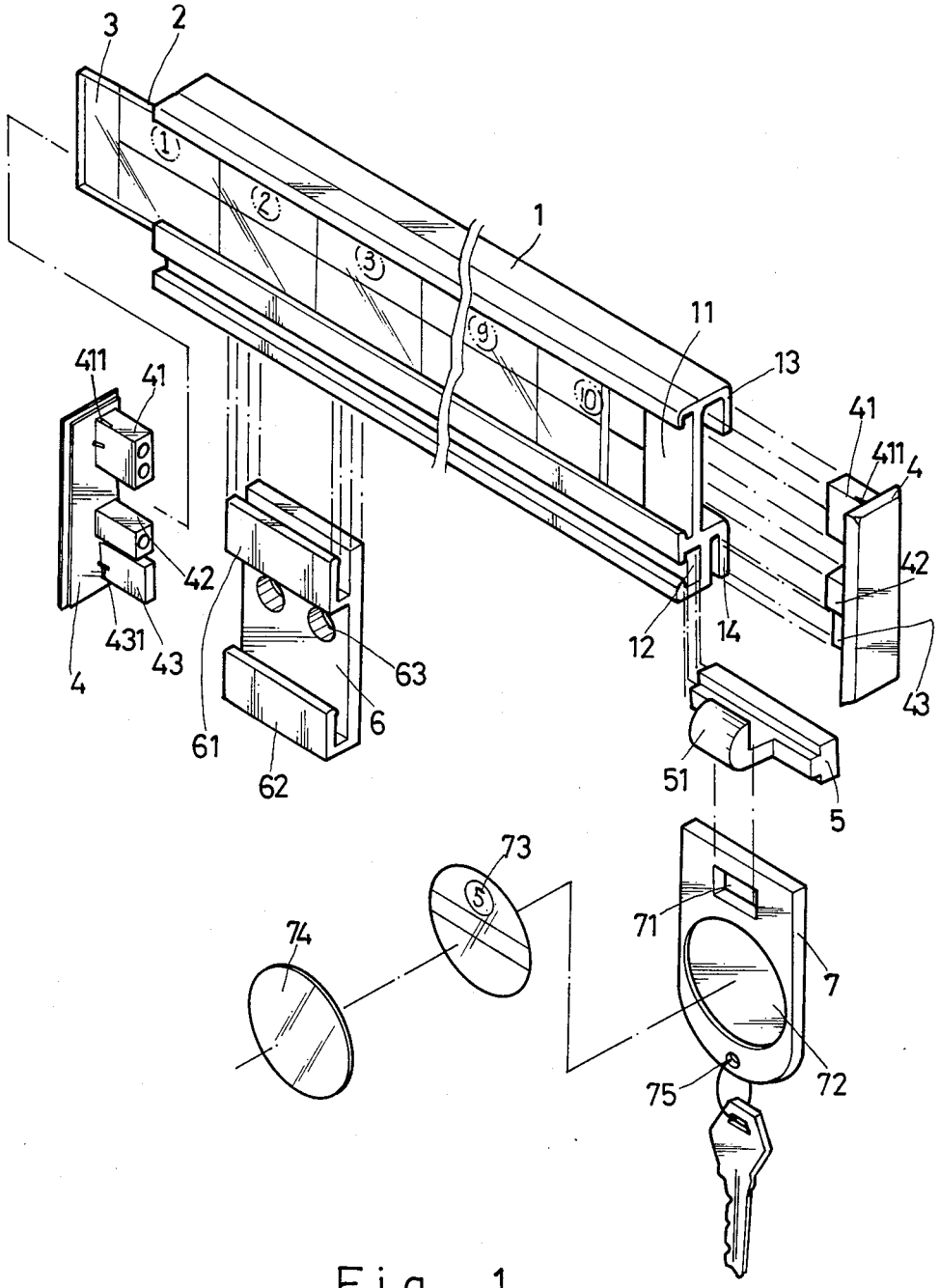
FIG. 1 is an exploded view of the device of this invention.
Figure 2:
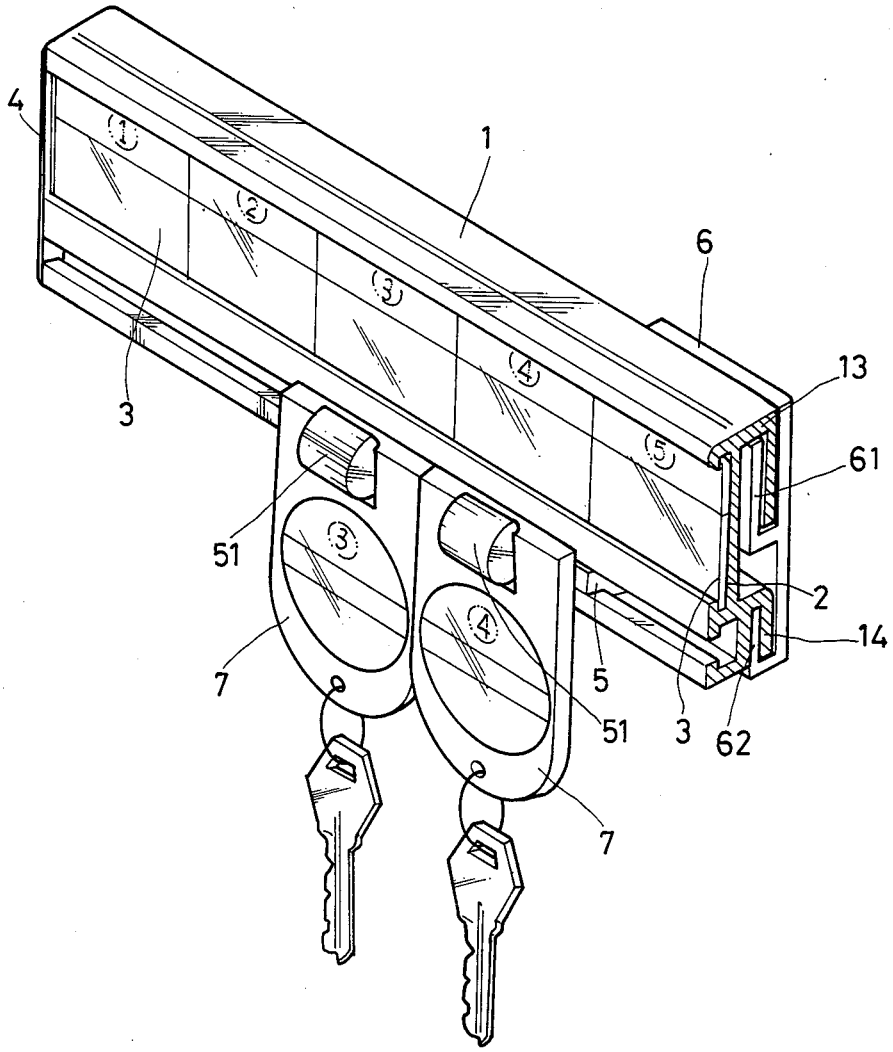
FIG. 2 is a perspective view in partial section of the device of this invention.

The device of this invention consists of a basic frame member 1, individual identification tablets 2 and a transparent window 3. When identification tablets 2 and window 3 are slidably received within frame member 1, end pieces 4 are also used as caps to retain the tablets and window in frame 1.

A sliding member 5 is also intended to be retained within frame member 1 and a mounting bracket 6 is disposed on the back of frame member 1. Each key then has an identification board 7 which engages the hook 51 on sliding member 5 as will be subsequently described.

The front face of frame member 1 has a first C-shaped slot 11 and a second C-shaped slot 12 respectfully at the upper and lower parts thereof. The back face of frame member 1 has a depending hook 13 in the upper portion and an inverted hook 14 in the lower portion. The identification tablets 2 and window 3 are intended to be inserted in slot 11 and the hook member is slidably received within slot 12. A separate hook member 5 is provided for each tablet member 2 so that the table member can contain identifying information as described above relative to the respective key.

The end cap members 4 are provided with different stud members 41, 42 and 43 by which the end cap members, when mounted on frame 1, are retained in inverted hooks 13 and 14. The cap members then are merely slidably retained within hooks 13 and 14.

The key identification board 7 is equipped with an aperture 71 and preferably is equipped with a concave edge 72 in which an identification card 73 may be placed with a removable transparent window 74. A small hole 75 is provided within which to hang the key so that when the key ring is in the hole as shown in FIG. 1, members 73 and 74 will be retained within member 7. The identification board 7 is then hung on the hook 51 disposed beneath the corresponding tablet 2.

The mounting bracket 6 is preferably provided with upper and lower upright hooks 61 and 62, respectively. The mounting bracket then may be affixed to a wall (not shown) by any convenient method such as by screws through aperture 63. The frame member 1 then may be slidably mounted on bracket 6 as hooks 61 and 62 engage hooks 13 and 14. The end cap members 4 then may be inserted within hooks 13 and 14 to complete assembly and mounting. The friction of stud members 41, 42 and 43 within hooks 13 and 14 is enhanced by members 411 and 431 which are formed on studs 41 and 43.

When this invention is mounted on a wall then a single central place for locating keys is established. The identification of each key will be present on its aligned identification tablet together with other information such as the owner's name, the lock which the key fits and the like. It is therefore very convenient to identify the key needed, or if one is missing, who most likely would have it.

The device of this invention then can be disassembled or assembled without the use of tools to add or delete the sliding hook members and identifying tablets as desired. As will be obvious to those skilled in the art, this invention is not intended to be limited to a specific length of the frame member and any convenient number of keys and tablets can be provided for.

I claim:

1. A wall mountable hanging device comprising:

a flat elongated frame member having front and rear faces and defining a first and second C-shaped slot extending across the front face and a first and second depending hook shaped slot extending across the rear face. The first C-shaped slot and the first hook shaped slot being disposed above the respective second C-shaped and hook shaped slots;

a plurality of key identification plates slidably received in the first C-shaped slot;

a plurality of hook members slidably received in the second C-shaped slot, each hook member being aligned with a respective plate and disposed with its hook extending from the slot;

a plurality of key identification boards, each having an aperture for receiving one of said hook members and means for mounting a key;

indicia means carried by said plates and boards for identifying each respective key; and mounting means slidably received in the hook shaped slots for mounting said device on a wall.

2. The device of claim 1 further comprising a transparent window member slidably received in the first C-shaped slot and disposed outwardly of said plates.

3. The device of claim 2 further comprising transparent window means mounted on each of said boards and covering said indicia means carried thereby.

4. The device of claim 3 further comprising end cap means slidably received in said first and second hook shaped slots at opposite ends thereof for retaining said plates and hook members in the respective C-shaped slots.

* * * * *